US006568149B2

(12) United States Patent
Lacasse

(10) Patent No.: US 6,568,149 B2
(45) Date of Patent: May 27, 2003

(54) SEALED GARAGE DOOR JOINT WITH THERMAL BREAK

(76) Inventor: Francis Lacasse, 141 De l'aiglon, St-Redempteur (CA), G6K-1P7

( * ) Notice: Subject to any disclaimer, the term of this patent is extended or adjusted under 35 U.S.C. 154(b) by 93 days.

(21) Appl. No.: 09/784,310

(22) Filed: Feb. 16, 2001

(65) Prior Publication Data

US 2002/0112444 A1 Aug. 22, 2002

(51) Int. Cl.[7] ..... E06B 7/22

(52) U.S. Cl. ..... 52/784.13; 52/784.16; 52/71; 52/802.1; 52/396.04; 160/232

(58) Field of Search ..... 52/784.13, 784.16, 52/800.1, 802.1, 800.12, 716.8, 71, 396.1, 396.04; 160/201, 229.1, 232, 235, 236

(56) References Cited

U.S. PATENT DOCUMENTS 3,967,671 A * 7/1976 Stanley et al. ..... 160/232
4,441,301 A * 4/1984 Benson ..... 52/784.13
4,823,531 A * 4/1989 Labelle ..... 52/71 X
4,854,365 A * 8/1989 Juneau ..... 160/232
5,170,832 A * 12/1992 Wagner ..... 160/201
5,533,312 A * 7/1996 Mihalcheon ..... 52/396.04 X
5,915,444 A * 6/1999 Sastri et al. ..... 160/229.1

FOREIGN PATENT DOCUMENTS

DE 2758824 * 7/1979 ..... 52/71

* cited by examiner

*Primary Examiner*—Laura A. Callo
(74) *Attorney, Agent, or Firm*—David J. French

(57) ABSTRACT

A joining strip is provided by which sheet metal may be formed into a hollow tubular panel. The joining strip provides a seam between panel edges that acts as a thermal break between inner and outer faces of the panel. The joining strip may also carry a resilient tubular cushion which extends into the joint between the side ends of two panels that are connected by a hinge. This cushion contributes to providing an air seal within the joint between the two panels. Applications include roll-up garage doors and roll-away, articulated walls.

22 Claims, 3 Drawing Sheets

SEALED GARAGE DOOR JOINT WITH THERMAL BREAK

FIELD OF THE INVENTION

This invention relates to sheet metal panels that are provided with a thermal break. It also relates to doors made from a series of such panels joined by hinged couplings to serve in a garage door or the like. In particular the invention relates to a method of sealing such joints to minimize the passage of air there through.

BACKGROUND TO THE INVENTION

Various technologies have been applied in the past to the joining of sheet metal panels to form doors having inner and outer faces. Further, such panels have been assembled with a series of hinged joints to provide a roll-up door. A particular application of this technology has been in the fabrication of garage doors.

It is useful to provide a thermal break between the pieces of sheet metal forming the inner and outer surfaces of a barrier such as a door. Particularly when the sheet metal is aluminum or steel, thermal conduction from an outer panel exposed to low temperatures can lead to the cooling of the inner panel with resulting condensation. Such condensation can eventually cause corrosion and damage to the door and its parts.

It is therefore one object of this invention to provide a means for joining two panels together that provides a thermal break for such panels.

It has been known to provide special shapes for adjoining edges of panels which are hinged to each other in order to minimize the risk that an object, e.g. a finger, may be pinched in the joint when the joint closes. Such edges are often provided with shapes of complementary curvature that permit the panels to be either aligned into a planar format, or oriented at an angle with respect to each other. Typically, one edge is generally of a convex, somewhat parabolic shape, while the other edge is concave with a complementary curvature. This minimizes the amount of gap that is formed when the joint opens.

The present invention incorporates into such a joint a sealing feature which minimizes the loss of air which might otherwise flow through the joint.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

In one broad aspect, the invention is a flexible joining strip preferably of resilient polymeric material providing two parallel slots to receive edges from respective inner and outer portions of a modular panel that is to form part of a roll-up door or wall. These panel portions are of a sheet material, preferably sheet metal. A central web separating the two slots provides the joining strip with a partially "M"-shaped cross-section. The central web extends below the base of the "M" to terminate in an inverted "T"-shaped flange with outwardly-extending lateral portions. The respective lateral portions of the "T" extend across the direct, aligned path of entry into the respective slots. The flange on the central web is, however, displaced sufficiently below the base of the "M" to provide an access path for entry of sheet edges into the respective slots.

The material of the joining strip has a thermal conductivity which is less than that of a metal. Thus, when serving to bind the seam between two metal sheets, the joining strip will provide a thermal break. The sealing strips may be fitted to the edges of the panel portions by sliding such strips onto the edges endwise. Alternatively, by forming the joining strip from material of a flexible nature, particularly when warmed, the outer sides of the slot may be flexed to admit the entry of the edges of the sheet material into the respective slots. Those edges may be bent or of a "hooked" shape in cross-section to fit into the slots. The flange is positioned to block the direct removal of the preferably hooked edges from the slots. This provides a stable coupling between the two edges of the sheet material panel portions.

When a panel is to be formed by joining two separate metal panel portions together, the paired edges along the top and bottom of both of the inner and outer sheet metal panel portions may be joined along their longitudinal edges to provide an inner, enclosed volume. Alternately, a single sheet of metal can be bent to provide both the inner and the outer faces of the panel. In this latter case only a single pair of edges need be joined by the joining strip to provide a single seam. While this arrangement is an option, a disadvantage of this arrangement is that the sheet metal along one edge of the panel is continuous, without a thermal break being present. For maximum thermal isolation, panels should be formed with separate inner and outer sheet metal portions, joined by two, upper and lower seams. Further and preferably, such two piece panel portions are symmetrical when assembled, allowing such parts to be produced from a single production die. Also preferably, the interior volume of each panel is filled with a stiffening insulation material such as polyurethane foam.

As a preferred feature, the outer face of the flange portion of the web on the joining strip carries a sealing member in the form of a hollow, flexible tubular cylinder which can be compressed into a flattened position adjacent to the flange to provide a sealing member. Preferably this tubular cylinder is made of a resilient material. When panels are assembled into an articulated door or wall, at least one seam should be equipped to provide a sealing member along a joining strip. Preferably two seams from adjacent panel longitudinal sides or ends may be provided with sealing members that contact each other and provide an improved airtight seal for a door when closed. By use of compliant material for the sealing member, the sealing member may be compressed within the space between adjoining seams of two door panels when the panels are brought into planar adjustment. It is not, however, necessary, for both joining strips to carry sealing members. It is sufficient for one joining strip to provide the necessary seal.

To allow panels to be assembled into an articulated wall or door having pinch-resisting joints, one of the longitudinal boundary edges or faces of each panel is preferably shaped to be generally convex, while the other longitudinal edge face is generally concave. The precise shape of these ends is selected to provide a close but not obstructing fit between these respective faces when one panel is rotated about a hinged axis with respect to the other panel. In the course of this rotation a portion of the joining strip, or sealing member if present, positioned along the seam formed on either the concave or the convex end of one panel may brush against the inner surface of the end of the other panel. This contact provides a barrier to entry of objects into the joint. Contact as described is permissible, however, only to the extent that motion between the two parts is not obstructed.

In this manner a joint is provided which provides a minimal gap that may pinch a person's fingers, acts as a thermal break between the inner and outer sheet metal portions of each panel, and further serves to create an airflow-resisting seal along the joints between panels when the panels are flattened out into a planar orientation with respect to each other.

The foregoing has provided a description of the invention and some of its optional aspects. The invention may be further understood by the description of the preferred embodiments, in conjunction with the drawings, which now follow.

DESCRIPTION OF THE PREFERRED EMBODIMENT

Figure 1:
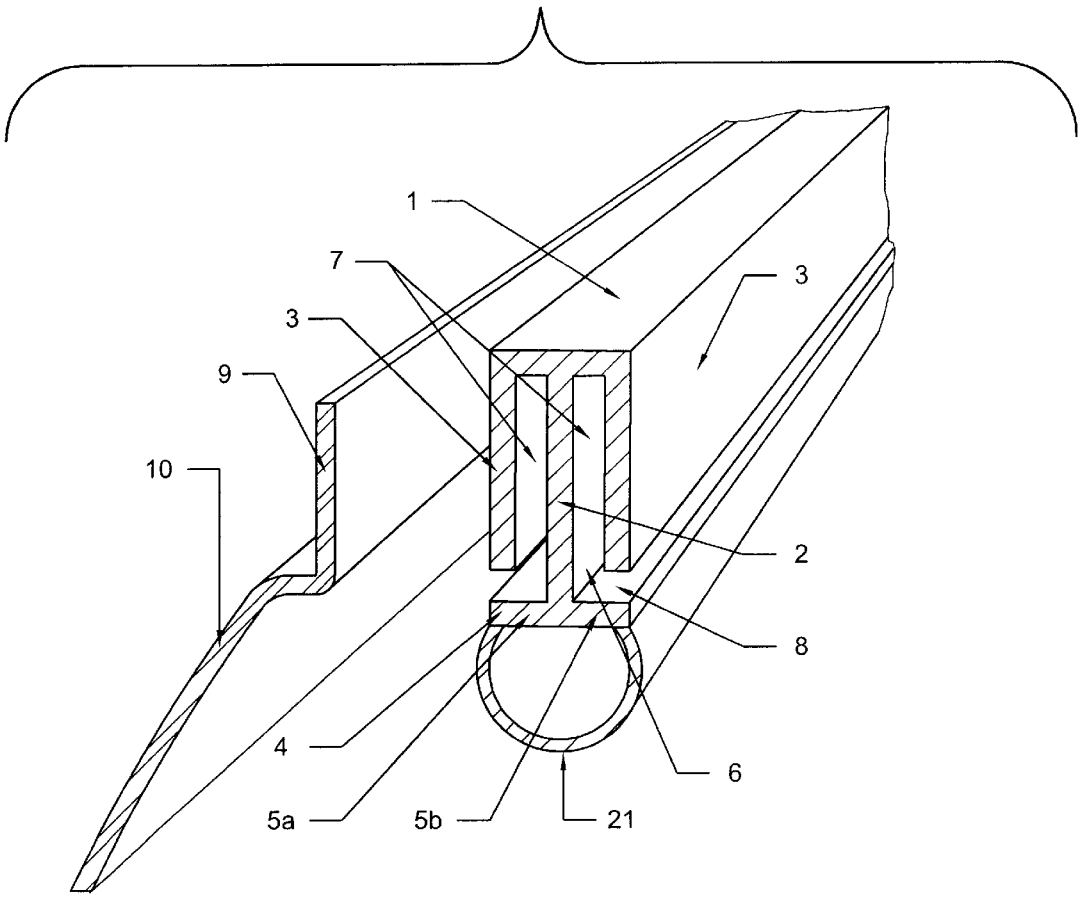
FIG. 1 is a schematic perspective view of a cross-sectioned sealing strip of the invention with the edge of a sheet metal panel positioned adjacent thereto, prior to being inserted into the sealing strip.

In FIG. 1 a sealing strip 1 has a central web 2 and two outer strips 3 that, along with web 2, provide an "M"-shaped cross-section.

The web 2 extends below the "M" to terminate in a flange 4, being of an inverted "T" shape in cross-section. The flange 4 has two laterally extending flange portions 5*a*, 5*b*.

The flange portions 5*a* 5*b* extend across the path 6 for direct entry into slots 7 present within the "M". The flange portions 5*a*, 5*b* are also displaced from the base of the "M" to provide an access path 8 for metal edges 9 on a sheet metal panel portion 10 to extend outwards from the slots 7.

Figure 2A:
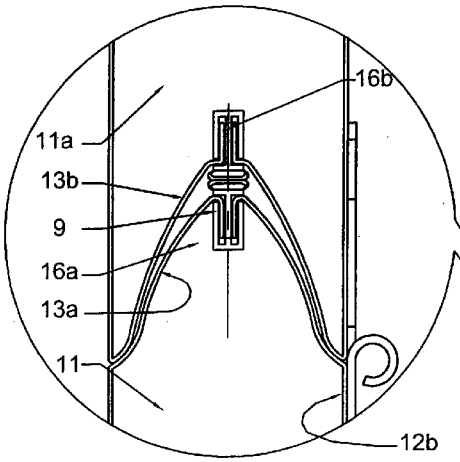
FIG. 2A is an enlarged end view detail of the joint between two sheet metal panels as in FIG. 2.
Figure 2B:
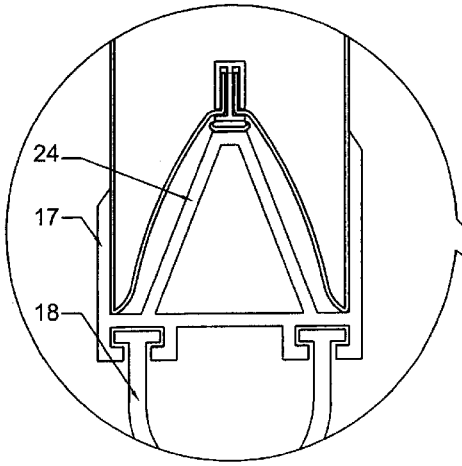
FIG. 2B is an enlarged end view detail of the bottom edge of the bottom panel of the door of FIG. 2.
Figure 2:
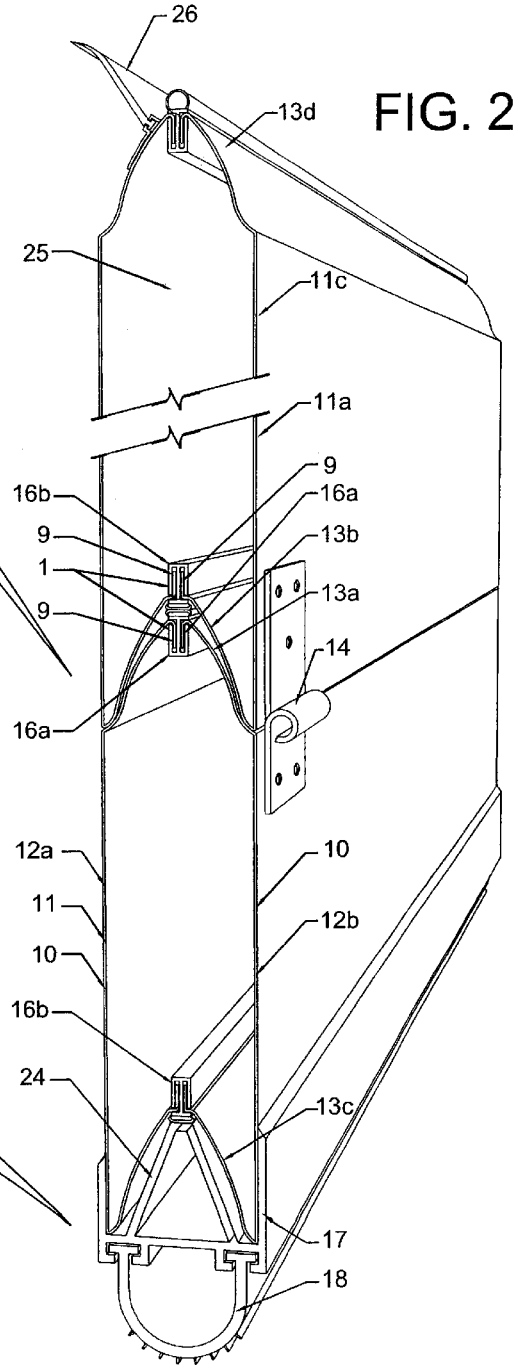
FIG. 2 is an end view of a garage door in perspective showing sheet metal hinged panels joined by sealing strips as in FIG. 1.

The sheet metal panel portion 10 is part of a sheet metal panel 11 shown in FIG. 2 composed of two panel portions 10 and having inner 12*a* and outer 12*b* faces and upper 13*a* and lower 13*b* longitudinal panel edge face. Conveniently, these panel portions 10 are symmetrical when assembled, allowing a single style of part to be used for either face 12*a*, 2*b* of a panel 11. As shown in FIG. 2 the upper panel end 13*a* is preferably convex and the lower end 13*b* is concave.

The shape of the respective panel ends 13*a*, 13*b* are such as to provide a non-obstructing rotation of one panel 11 with respect to an adjacent panel 11*a* about a laterally mounted hinge 14. This is shown in detail in FIG. 3. Preferably the longitudinal edge face of each panel are symmetrical about a central plane lying between the two face portions. This shape also minimizes the presence of a gap 23 wherein a person's fingers may become pinched.

The joining of the inner 12*a* and outer 12*b* panel faces is effected along seams 16*a*, 16*b* within the longitudinal edge faces 13*a*, 13*b*. A sealing strip 1 present at each seam 16*a*, 16*b* receives edge portions 9 from each of the panel faces 12*a*, 12*b*. This is shown in detail in FIG. 2A, wherein the "M" of the joining strip is positioned towards the interior of the panel, and the inverted "T" of the joining strip is positioned towards the exterior of the panel.

In FIG. 2 both the top 13*a* and bottom 13*b* panel longitudinal edge faces, or "longitudinal faces", have seams 16*a*, 16*b*. One sheet of metal could, however, be bent to form a panel 11 with a single seam. The interior volume of each panel 11 is preferably filled with an insulating and structural stiffening material such as polyurethane foam 25. This is shown pictorially in the top panel 11*c* of FIG. 2 by the field of dots.

The panels 11 are modular to permit assembly into a roll-up door or the like. The panel longitudinal face 13*c* of the bottom panel 11 may receive a capping member 17 that fits over the face 13*c*. The bottom of the capping member 17 is preferably fitted with a resilient semi-circular strip 18 to serve as a bumper or edge protector when the door approaches the floor. The capping member 17 may also optionally include a sealing strut 24 extending to the seam 16*b*.

At the top of the door, a resilient strip 26 may seal the top boundary longitudinal face 13*d* of the door against a frame when the door is closed.

The sealing strip 21 fitted along the bottom face of the flange 4 on each sealing members 21 is dimensioned and positioned to create a seal with an adjacent panel longitudinal face 13*a*, 13*b* when the panels 11 are in a coplanar orientation i.e., when the door is closed. Such sealing members 21 may be present on one or both of the seams 16*a*, 16*b* of abutting panels 11. As well as providing a seal, the sealing members 21 can act as a cushion and reduce noise arising from opening or closing of the door.

In FIGS. 2 and 2A two strips 1 on adjacent panels 11*a*, 11*b* virtually abut with each other when the panels 11*a*, 11*b* are in a planar orientation to each other. This deforms the sealing members 21 due to their intimate contact with each other, providing an air seal. While shown as a tubular, resilient, partial cylindrical member in FIG. 1, this sealing member 21 may also be in the form of resilient strips (not shown), e.g. the cylindrical member may be slit longitudinally. The object is simply that the sealing member 21 will serve as a seal.

Figure 3:
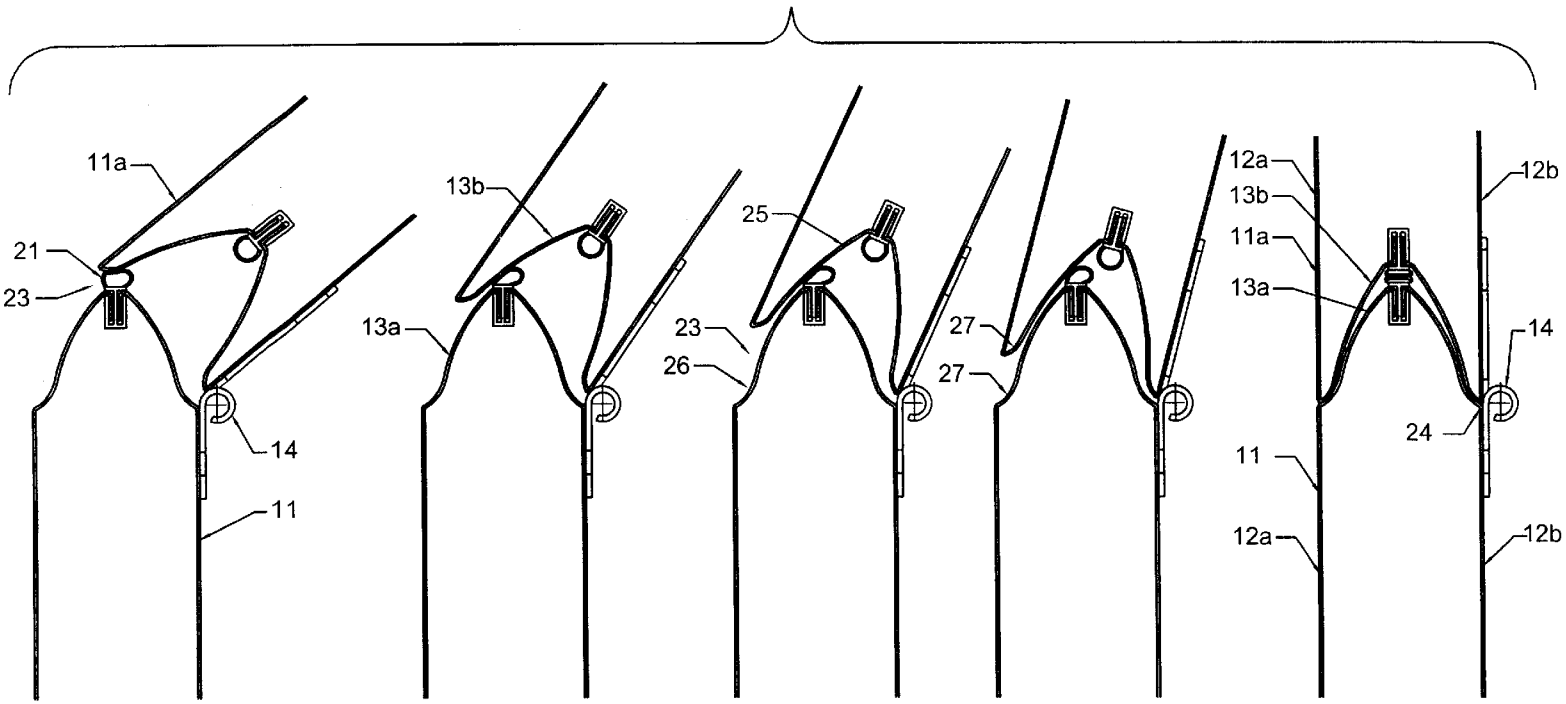
FIG. 3 is a progressive series of detailed end views of the closing action of the joint between adjacent panel edges of the door of FIG. 2.

The sealing effect with cylindrical sealing members 21 is shown progressively in FIG. 3 where the stages of closing a garage door are depicted. Panels 11*a*, 11*b* rotate about hinge 14 towards closing. The edge faces 13*a*, 13*b* are shaped to minimize the risk of pinching an object in the closing gap 23 between the edges 13*a*, 13*b*. The sealing strip 1 with sealing member 21 on the convex face 13*a* just brushes against the surface of the concave face 13*b* as closing proceeds. When the sealing members 21 on the strips contact each other, they deform and flatten to provide the seal and cushioning effect.

The hinge 14 is preferably positioned on the panel face surface 12*b* of each panel 11, at the point 24 where faces 13*a*, 13*b* meet. With the hinge 14 at this location 24, surface points 25 on the moving panel longitudinal face 13*b* follow a circular trajectory about the hinge axis. The remote portion 26 of longitudinal face 13*a*, removed from the hinge 14, may also be curved in a similar circular path. In this manner, the gap 23 is minimized for a substantial portion of the closing action.

An inflection zone 27 in the end faces 13*a*, 13*b* near the outer face portions 12*a* of each panel portion 10, located opposite to the hinge 14, can be shaped to close the gap 23 when the door is closed. At this inflection zone 27, the longitudinal faces 13*a*, 13*b* may come fully into contact presenting a closed surface on the face of the door opposite to the hinge.

CONCLUSION

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure.

The embodiments of the invention in which an exclusive property or privilege is claimed are defined as follows:

1. A joining strip for joining two sheeting edges, said strip being provided with two parallel slots to receive such edges, said strip having a central web separating the two slots to provide the joining strip with a partially "M" shape in cross-section, the central web extending below the base of the "M" to terminate in a cross-sectionally inverted "T"-shaped flange with outwardly extending lateral portions and an outwardly directed outer face, the respective lateral portions of the flange extending across the direct, aligned path of entry into the respective slots to block direct removal from said slot of an edge fitted into said slot, the lateral portions of the flange on the central web being displaced sufficiently below the base of the "M" to provide an access path for said edges to extend into the respective slots, said flange carrying a sealing member extending along the outer face of the flange, remote from the central web.

2. A strip as in claim 1 wherein the strip and sealing member are made of a resilient, polymeric material having a thermal conductivity that is less than the thermal conductivity of a metal.

3. A strip as in claim 2 wherein said sealing member comprises a hollow, flexible tubular cylinder which can be compressed into a flattened condition adjacent to the flange.

4. A panel formed from one or more strips as in claim 1 in combination with inner and outer panel side portions of sheet material combined to provide the panel with upper and lower longitudinal faces, each panel side portion respectively having a longitudinal edge extending along at least one longitudinal face of such panel wherein said panel side portion longitudinal edges are coupled together by being respectively inserted into said respective slots in the joining strip to provide a seam between said panel side portions.

5. The panel of claim 4 wherein said panel side portions are separate panel portions, each separate panel portion having top and bottom longitudinal edges extending along both top and bottom longitudinal faces of the panel, and wherein said panel portion top and bottom longitudinal edges are joined respectively by a respective top and bottom joining strip to form the panel.

6. An articulated door or wall formed of a plurality of adjacent panels each as in claim 5 to provide said articulated door or wall, said panels being joined by hinge means each with a hinge axis.

7. An articulated door or wall as in claim 6 wherein of said upper and lower longitudinal faces, one of said longitudinal faces is shaped to be generally convex, while the other longitudinal face is generally concave to provide a close but not obstructing fit between the respective longitudinal faces when one panel is rotated about the hinge axis with respect to the other panel.

8. An articulated door or wall as in claim 7 wherein the sealing member of each said joining strip each bears against the sealing member of another joining strip when the panels are flattened out into a planar orientation with respect to each other.

9. An articulated door or wall as in claim 6 wherein the hinge axis for each adjacent pair of panels is located proximate to the abutting longitudinal faces of said adjacent panels and wherein portions of the longitudinal faces of the respective hinged panels are generally concentrically curved about said hinge axis and juxtaposed to each other to minimize the gap formed between adjacent panels when adjacent panels are bent out of planar alignment with each other.

10. An articulated door or wall as in claim 9 wherein the longitudinal faces of the respective hinged panels are symmetrical in cross-section about a central plane that lies between the inner and outer panel side portions.

11. An articulated door or wall as in claim 10 wherein the sealing member of each said joining strip each bears against the sealing member of another joining strip when the panels are flattened out into a planar orientation with respect to each other.

12. A panel as in claim 4 wherein said panel side portions are formed of a single sheet of metal having two longitudinal edges said single sheet being bent to provide both the inner and the outer side portions of the panel.

13. An articulated door or wall formed of a plurality of adjacent panels each as in claim 4 to provide said articulated door or wall, said panels being joined by hinge means each with a hinge axis.

14. An articulated door or wall as in claim 13 wherein of said upper and lower longitudinal faces, one of said longitudinal faces is shaped to be generally convex, while the other longitudinal face is generally concave to provide a close but not obstructing fit between the respective longitudinal faces when one panel is rotated about the hinge axis with respect to the other panel.

15. An articulated door or wall as in claim 14 wherein the sealing member portion of the joining strip along the seam formed on the convex longitudinal face of one panel brushes against the inner surface of the concave longitudinal face of the other panel when one panel is rotated about the hinge axis with respect to the other panel.

16. An articulated door or wall as in claim 14 wherein the sealing member bears against an adjacent panel when the panels are flattened out into a planar orientation with respect to each other.

17. An articulated door or wall as in claim 13 wherein the hinge axis for each adjacent pair of panels is located proximate to the abutting longitudinal faces of said adjacent panels and wherein portions of the longitudinal faces of the respective hinged panels are generally concentrically curved about said hinge axis and juxtaposed to each other to minimize the gap formed between adjacent panels when adjacent panels are bent out of planar alignment with each other.

18. An articulated door or wall as in claim 17 wherein the longitudinal faces of the respective hinged panels are symmetrical in cross-section about a central plane that lies between the inner and outer panel side portions.

19. An articulated door or wall as in claim 18 wherein the sealing member bears against an adjacent panel when the panels are flattened out into a planar orientation with respect to each other.

20. An articulated door or wall formed of a plurality of adjacent panels each comprising inner and outer panel side portions of sheet material joined by a pair of joining strips to provide interior for said panel, each joining strip being provided with two parallel slots to receive such edges, said strip having a central web separating the two slots to provide the joining strip with a partially "M" shape in cross-section, the central web extending below the base of the "M" to terminate in a cross-sectionally inverted "T"-shaped flange with outwardly extending lateral portions and an outwardly directed outer face, the respective lateral portions of the flange extending across the direct, aligned path of entry into the respective slots to block direct removal from said slot of an edge fitted into said slot, the lateral portions of the flange on the central web being displaced sufficiently below the base of the "M" to provide an access path for said edges to extend into the respective slots, said panel side portions being combined to provide the panel with upper and lower longitudinal faces, each panel side portion respectively having top and bottom longitudinal edges extending along both top and bottom longitudinal faces of the panel, and wherein said panel portion top and bottom longitudinal edges are joined respectively by a respective top and bottom joining strip by being respectively inserted into said respective slots in the respective joining strip to provide upper and lower seams between said panel side portions, to form the panel, wherein the "M" of the joining strip is positioned towards the interior of the panel, and the inverted "T" of the joining strip is positioned towards the exterior of the panel, said panels being joined by hinge means each with a hinge axis, and wherein of said upper and lower longitudinal faces, one of said longitudinal faces is shaped to be generally convex, while the other longitudinal face is shaped to be generally concave to provide a close but not obstructing fit between the respective longitudinal faces when one panel is rotated about the hinge axis with respect to the other panel.

21. An articulated door or wall as in claim 20 wherein:

(1) the hinge axis for each adjacent pair of panels is located proximate to the abutting longitudinal faces of said adjacent panels and (2) portions of the longitudinal faces of the respective hinged panels are generally concentrically curved about said hinge axis and juxtaposed to each other to minimize the gap formed between adjacent panels when adjacent panels are bent out of planar alignment with each other.

22. An articulated door or wall as in claim 21 wherein the longitudinal faces of the respective hinged panels are symmetrical in cross-section about a central plane that lies between the inner and outer panel side portions and said joining strips are positioned within said central plane.

* * * * *